US005107274A

United States Patent [19]

Mitchell et al.

[11] Patent Number: 5,107,274

[45] Date of Patent: * Apr. 21, 1992

[54] COLLOCATED NON-INTERFERING DUAL FREQUENCY MICROWAVE FEED ASSEMBLY

[75] Inventors: Rodney A. Mitchell, Tujunga; Gerry B. Blachley, Simi Valley, both of Calif.

[73] Assignee: National ADL Enterprises, Simi Valley, Calif.

[ * ] Notice: The portion of the term of this patent subsequent to Feb. 20, 2007 has been disclaimed.

[21] Appl. No.: 405,548

[22] Filed: Sep. 11, 1989

Related U.S. Application Data

[63] Continuation of Ser. No. 105,135, Oct. 2, 1987, Pat. No. 4,903,037.

[51] Int. Cl.[5] ..... H01Q 13/02

[52] U.S. Cl. ..... 343/756; 343/786; 333/21 A; 333/135

[58] Field of Search ..... 343/756, 762, 766, 776, 343/786; 333/21 A, 135

[56] References Cited

U.S. PATENT DOCUMENTS

| | | | |
|---|---|---|---|
| 4,504,836 | 3/1985 | Seavy | 343/786 |
| 4,544,900 | 10/1985 | Howard | 333/21 A |
| 4,554,532 | 11/1985 | Alford et al. | 343/786 |
| 4,554,553 | 11/1985 | Grim | 343/786 |
| 4,679,009 | 7/1987 | Cloutier | 333/21 A |
| 4,740,795 | 4/1988 | Seavey | 343/786 |
| 4,903,037 | 2/1990 | Mitchell et al. | 343/762 |

OTHER PUBLICATIONS

Koch et al., "Coaxial Radiator as Feed for Low Noise Paraboloid Antennas", Nachrichtentech, Z., vol. 22, pp 166–173, 1969.

Jeuken et al., "A Dual Frequency, Dual Polarized Feed for Radioastronomical Applications", *Nachrichtentech, Z.*, vol. 25, pp. 374–376, 1972.

Livington, "Multifrequency Coaxial Cavity Apex Feeds", *Microwave Journal*, vol. 22, pp. 51–54, Oct., 1979.

IEEE Transaction on Antennas & Propagation, vol. AP-34, No. 8, Aug., 1986 "Input Mismatch of $TE_{11}$ Feeds Mode Coaxial Waveguide", Trevor S. Bird, Grameme L. James & Stephen J. Skinner, pp. 1030–1033.

IEEE Transactions on Microwave Theory & Techniques, vol. MTT-35, No. 4 Apr., 1987, "Admittance of Irises in Coaxial & Circular Waveguides for $TE_{1-1}$-Mode Excitation", Graeme L. James, pp. 430–434.

*Primary Examiner*—Michael C. Wimer

*Attorney, Agent, or Firm*—Pretty, Schroeder Brueggemann & Clark

[57] ABSTRACT

A dual frequency feed assembly for an antenna system having two coaxial cavities, with a smaller, high-frequency cavity mounted coaxially within a larger, low-frequency cavity. A separately rotatable probe is mounted within each cavity. The smaller cavity is mounted within the larger cavity by any of several structures, such as a ring-shaped spider, a ring-shaped spacer in the form of a planar washer, or a harp extending rearwardly in the larger cavity.

20 Claims, 5 Drawing Sheets

FIG. 6
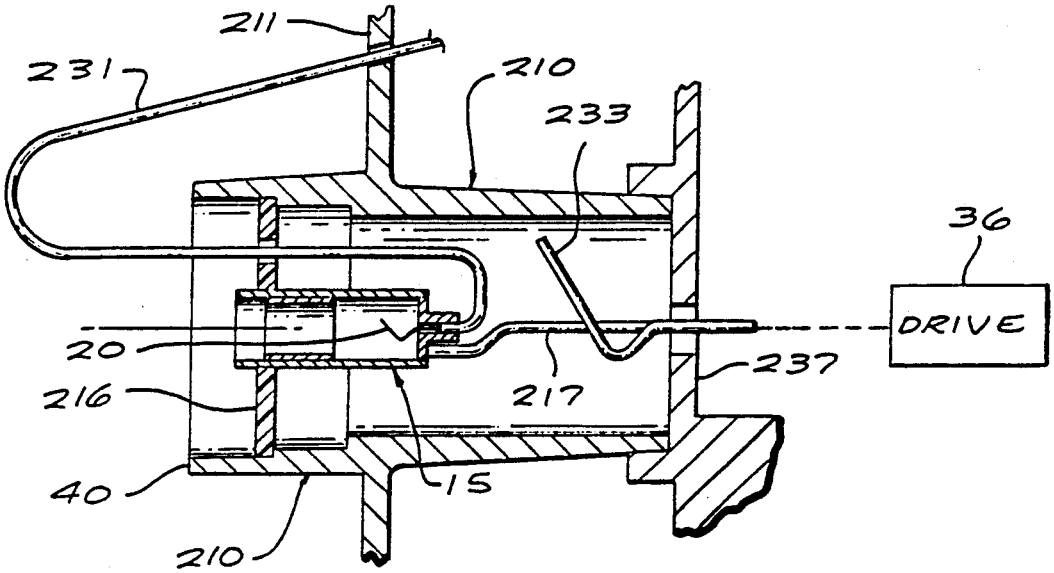
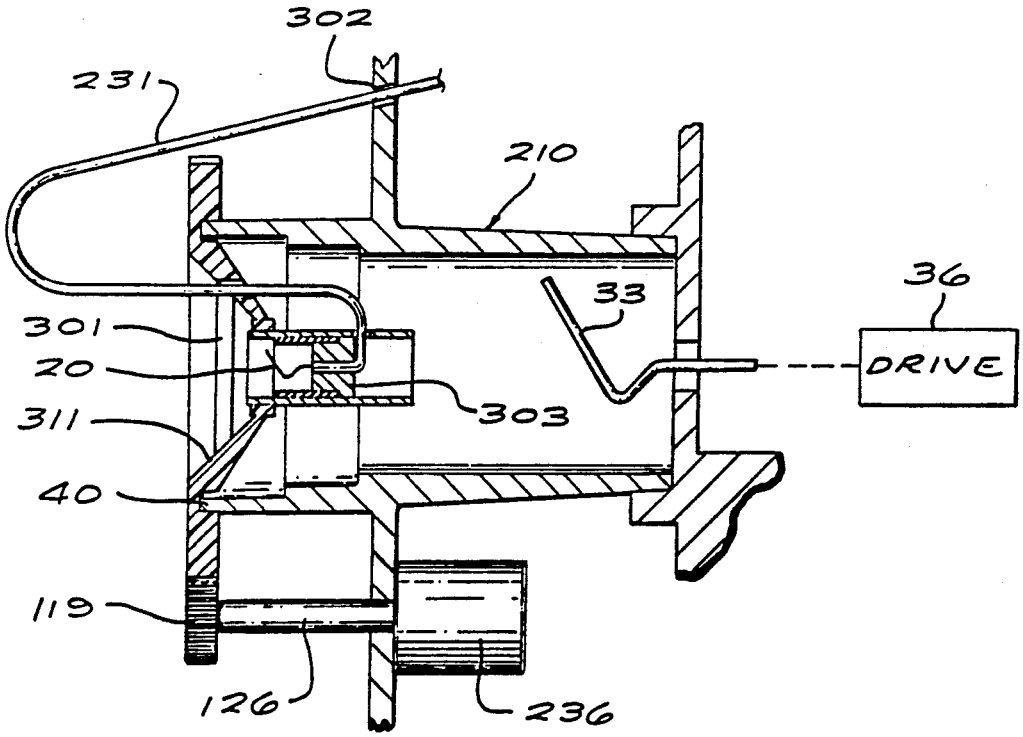
FIG. 7

FIG. 10
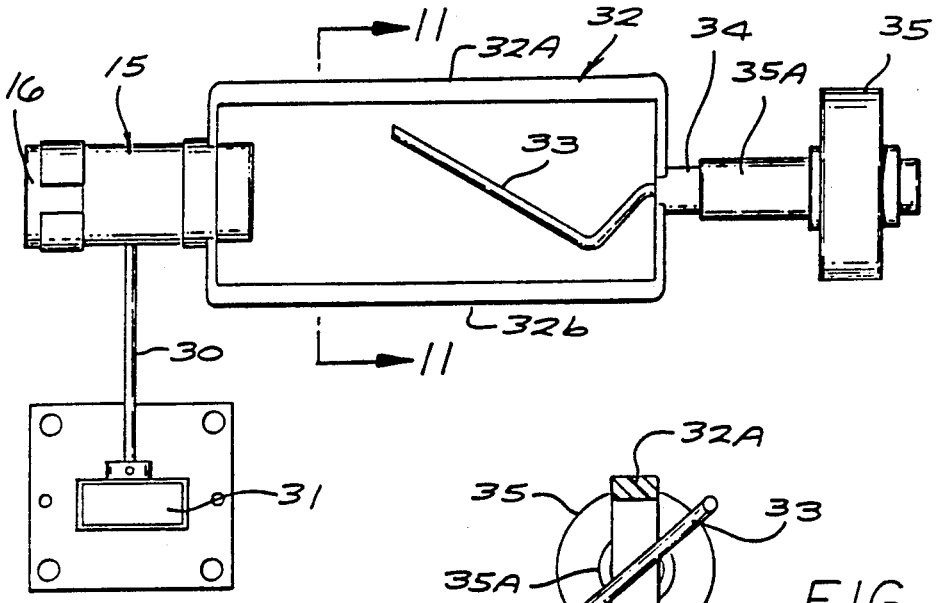
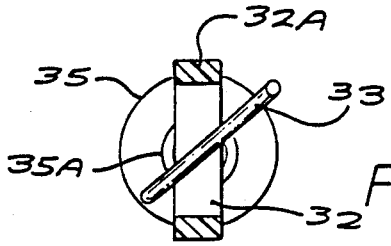
FIG. 11
FIG. 13
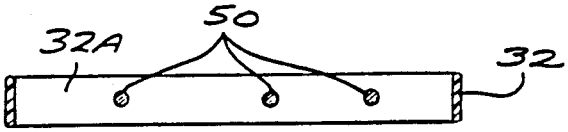
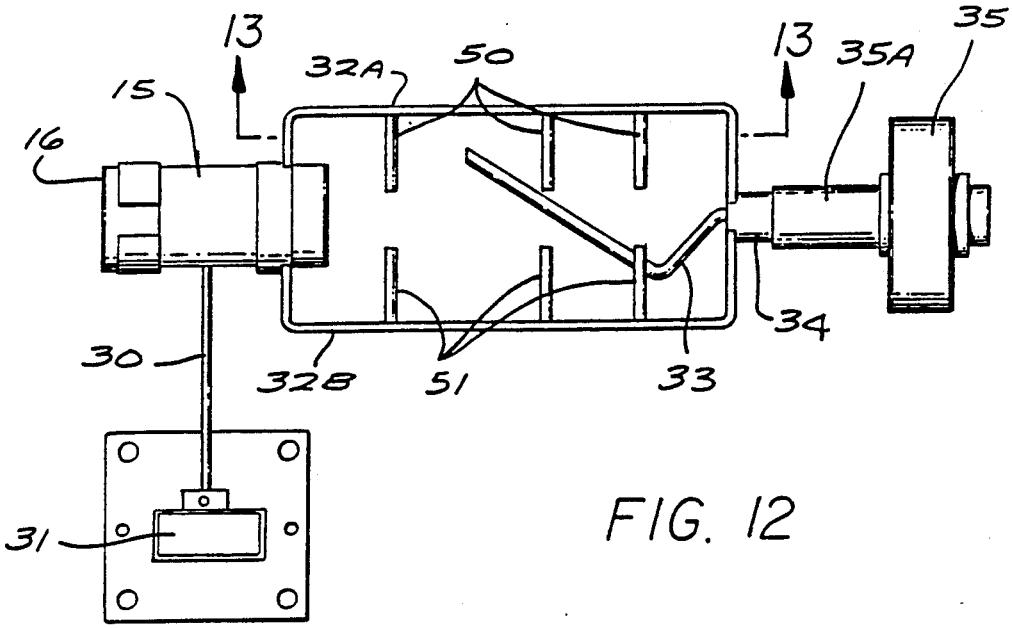
FIG. 12

COLLOCATED NON-INTERFERING DUAL FREQUENCY MICROWAVE FEED ASSEMBLY

REFERENCE TO RELATED APPLICATIONS

This is a continuation application of U.S. Ser. No. 07.105,135 filed Oct. 2, 1987, now U.S. Pat. No. 4,903,037.

BACKGROUND OF THE INVENTION

With the recent growth in numbers of communication satellites in orbiting operation around the earth, the number of receiving stations has grown explosively in the last few years. Each of these receiving stations requires an antenna capable detecting signals at levels in the range of −120 dbm to −30 dbm while rejecting terrestial interference (TI) and capable of polarization control employing a servo motor. It is further desirable for maximum utility that a single feed assembly exhibit the capability of operating simultaneously in two different frequency bands, for example, the C band of 3.7 to 4.2 GHZ and the Ku band of 11.7 to 12.2 GHZ or the optional Ku band of 10.95 to 11.7 GHZ.

It is desirable for dual frequency feed assemblies to have their probe axes coaxial with a common reflector for maximum received signal strength at each frequency and to minimize unwanted side lobes. Coaxial mounting of dual frequency feeds without cross coupling and interference has not been effectively achieved heretofore. Studies have been made of input mismatches developed in TE11 mode coaxial feeds as well as the use of irises and their effects in coaxial waveguides. These studies, while helpful, have not given clear guidance for the design of an optimum dual frequency band coaxial feed assembly.

One attempt at a coaxial C and Ku band receiver antenna employs a plurality of wires surrounding the Ku band aperture to bypass it as an obstruction and introduce it into the C band polarizer behind the Ku band assembly. A common servo motor rotates the Ku band and C band probes.

BRIEF DESCRIPTION OF THE INVENTION

Faced with this state of the art and a continuing need for improved feed assemblies, one object of our invention is to provide a dual frequency, e.g. C and Ku band satellite communications band antenna having a common focal point in order to give improved antenna efficiency and to minimize distortion commonly found in side by side antennas.

A second object of this invention is to provide a dual frequency antenna in which a polarization adjustment is remotely and accurately controllable at both frequencies and by a single remote control.

A further object of this invention is to use an existing apparatus for polarization adjustment for one frequency, preferably the lower of the two frequencies and attach a device to it to change the polarization of the higher frequency probe.

One further object of this invention is to extract signals in the higher frequency signal band without interference with the lower frequency operation and, in fact, seek to improve the operation at the lower frequency.

Still another object of this invention is to extract the higher frequency signal without blocking the lower frequency signal in any polarization.

One other object of this invention is to dimension the components of a dual frequency feed assembly to establish a resonant condition in the low frequency signal path whereby the feed for the high frequency actually enhances low frequency operation.

Each of these objectives have been achieved in a dual frequency feed system including a feed horn body defining a pair of coaxial annular recesses, each containing a rotatable probe, the inner and smaller probe preferably tuned to respond at the Ku band and the larger probe responding to the C band of frequencies. The inner or Ku band probe in an aperture is fed by a radial feed extending through the wall of the C band aperture wall and through a wall of a Ku band rectangular wave guide which support a feed probe therein.

To the rear of the Ku band aperture and probe is a drive shaft and harp surrounding a C band probe. The harp encloses the C band probe and serves to support and rotate the Ku band probe in its aperture. The rear of the drive shaft constituting the C band probe holder extends through the rear wall of the feed horn and through the major walls of a C band rectangular waveguide, through a thermal barrier and is coupled to a servo motor contained within a rear housing. Both of the waveguides are sealed to the horn body with the C band waveguide including an integral 90 degree bend so that both waveguides feed to the rear of the feed horn suitable for coupling to a single or dual low noise amplifiers which are not part of this invention. The single motor adjusts the polarization of both probes simultaneously.

In another embodiment, the C band aperture is closed by a microwave transparent disk which mounts a ring gear for rotation of the Ku band probe from the front of the horn by a motor mounted at the rear and driving the ring gear through an elongated shaft which extends to a point generally coplanar with the coaxial apertures and outside of the C band aperture.

A third embodiment of this invention involves a front feed for the higher frequency probe and rear feed for the lower frequency probe.

In still a fourth embodiment, the low frequency and higher frequency probes each have individual polarization drive motors, one driving the lower frequency probe coaxially through the rear similar to the first embodiment and the higher frequency probe driven by a ring gear similar to the second embodiment.

One further embodiment involves the addition of phase shifting material, either dielectric or conducting material, in the C band cavity to cause phase delay of one component of circularly polarized signals and transform them to linear polarization to be detected by the C band probe. The dielectric or conducting material is preferably oriented at 45 degrees and with respect to the angular orientation probe. This can be in the form of inwardly extending pins or longitudinally extending bars on support structures within the cavity.

BRIEF DESCRIPTION OF THE DRAWING

This invention may be more clearly understood from the following detailed description and by reference to the drawing in which:

FIG. 6 is a diametrical sectional view of the third embodiment of FIG. 5;

FIG. 7 is a fragmentary diametrical sectional view of a fourth embodiment of this invention.

FIG. 10 is a side elevational view of a probe assembly with a phase shifter attached to a support harp;

FIG. 11 is a fragmentary sectional view along line 11—11 of FIG. 10 showing a C band probe oriented with respect to a phase shifter pair.

FIG. 12 is a side elevational view of a series of phase shifters mounted on a harp probe support structure; and FIG. 13 is a fragmentary sectional view of the harp and phase shifter taken along line 13—13 of FIG. 12.

DETAILED DESCRIPTION OF THE INVENTION

Figure 1:
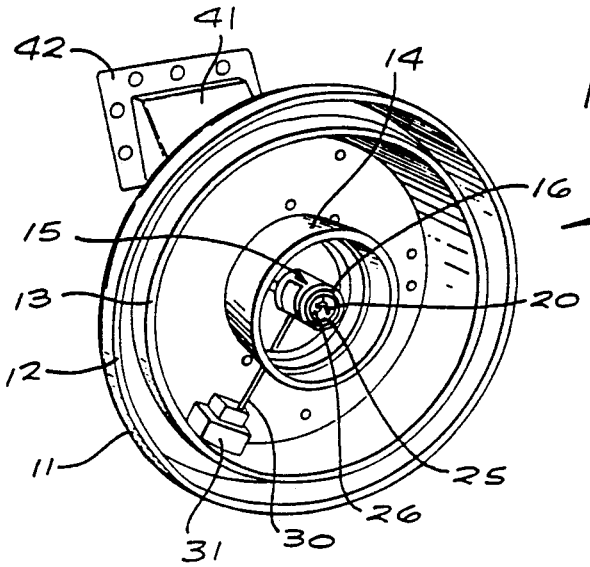
FIG. 1 is a perspective view of a horn assembly in accordance with this invention.
Figure 4:
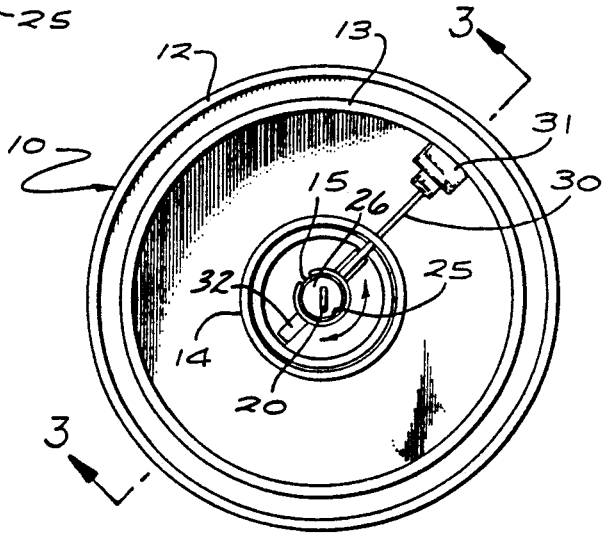
FIG. 4 is a front elevational view of this invention.

Now referring to FIGS. 1 and 4, a dual frequency feedhorn and polarizer assembly generally designated 10, may be seen ready to be installed in a reflector dish for receiving satellite communication signals. The assembly 10 includes a circular feedhorn 11 having a pair of outer annular rings 12 and 13 which encircle a C band aperture defined by annular tube 14.

Coaxially located within the tube 14 is a Ku band feed assembly 15 including a sleeve 16 defining the Ku band aperture and a rotatable probe 20 dimensioned to detect circularly polarized signals in the plane of polarization of the probe 20. The sleeve 16 is part of a cup shaped member 25 seen in FIG. 2, having a central aperture through which the probe 20 extends. The probe 20 is insulatingly mounted on a coaxial probe support 26 at the rear of the cup shaped member 25. A rear part of the probe support 26 includes a side slot, unshown in the drawing, through which a coaxial or centerline feed conductor 30 passes between the probe 20 and a Ku band wave guide adapter 31 mounted on the rear face of the feed body 11 and providing a Ku band wave guide termination. The centerline feed conductor 30 extends into the wave guide adapter 31 to couple microwave energy detected by the Ku band probe 20 to an external wave guide for transmission to a low noise amplifier, which is unshown in the drawing but normally associated with feed assemblies, to amplify the detected signals.

The centerline feed conductor 30 enters the cavity behind the probe 20 via the slot described above and extends to the rear or bottom of the support 26 and there forms a U bend to a coaxial position at 17 (FIG. 2) extending toward the Ku band aperture and joining the probe 20. The probe 20 itself is secured to the probe support member 26 and is free to rotate with the aperture defining sleeve 16. The sleeve 16 is held in a spring grip of an insulating extension 27A of a harp 32, best seen in FIG. 3. A similar ring-shaped extension 27B of the harp 32 encircles the support member 26.

Figure 3:
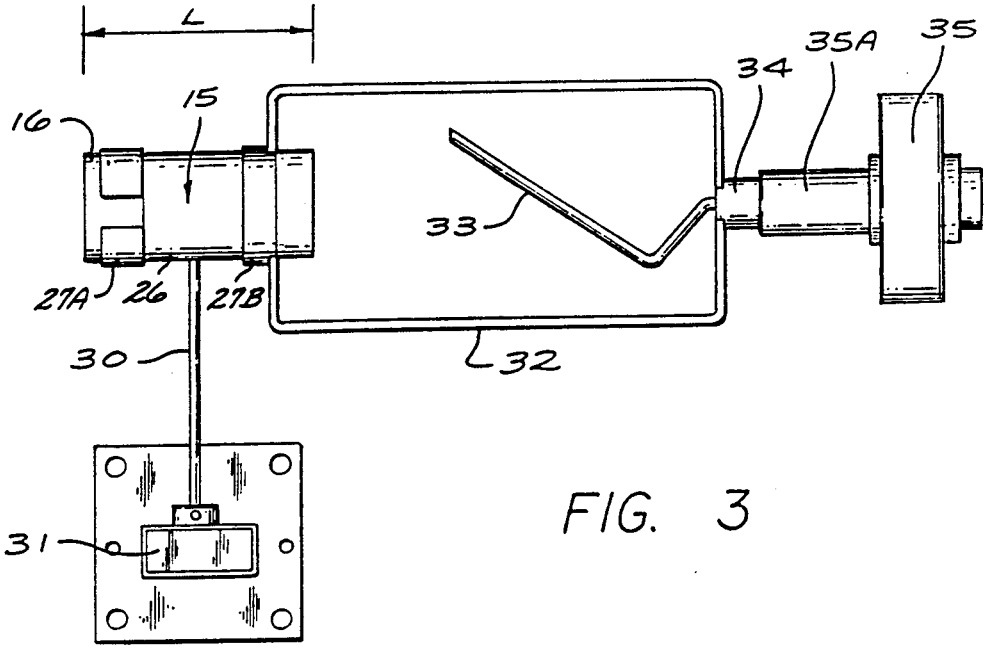
FIG. 3 is an enlarged side elevational view of the probe and probe holder assembly of this invention.
Figure 2:
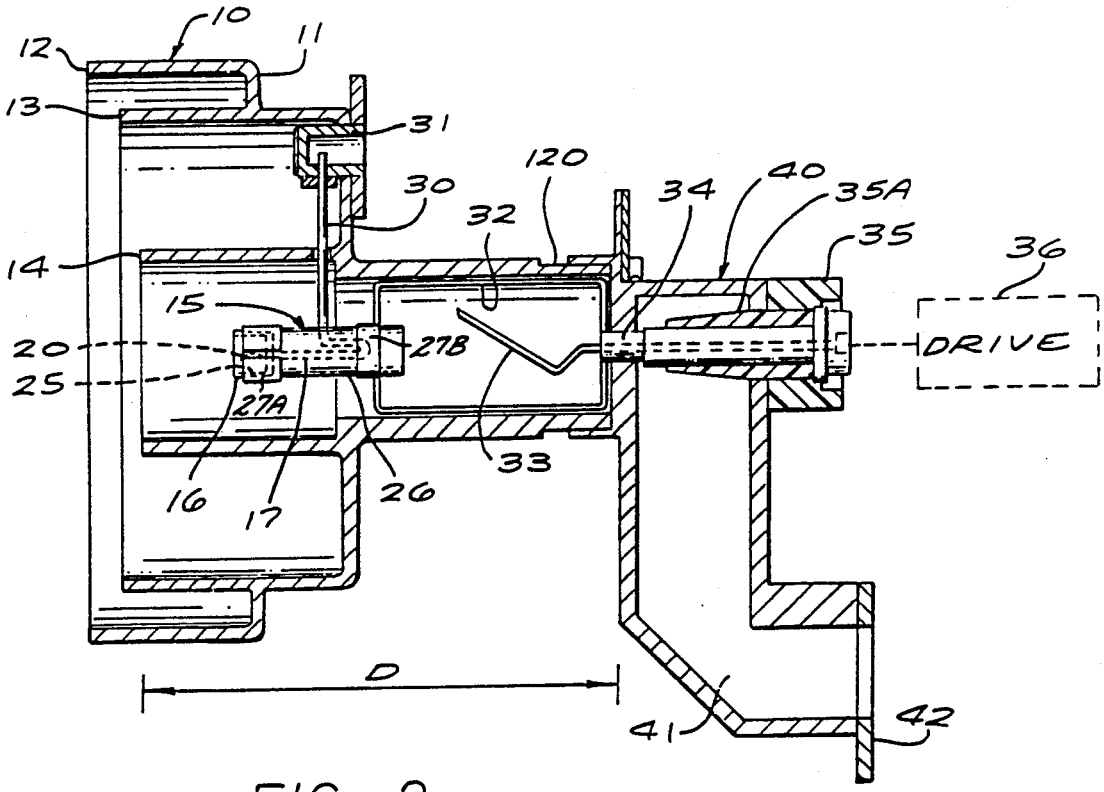
FIG. 2 is a vertical sectional view through the horn, feed and drive assembly of this invention.

The harp 32 encircles a C band feed 33 of FIG. 3 located behind the Ku band probe assembly 15 and therefore is not visible in FIG. 1 but is clearly shown in FIGS. 2 and 3. The C band probe 33 and harp 32 are coupled via shaft 34 and thermally insulating bearing block 35 with its extension 35A to a servo motor 36 illustrated in FIG. 2 by a dashed line labeled drive. The C band probe 33 extends part way through the shaft 34 which itself extends through the termination of a C band wave guide section 40 which includes a 90 degree bend 41 and a flange 42. The flange 42 is adapted to be coupled to additional wave guide sections to the low noise amplifier.

As is apparent in FIGS. 2 and 3, the Ku band probe 20 and the C band probe 33 are both mechanically secured to the harp 32 and therefore are both capable of simultaneous movement under the control of the servo drive 36. Both the Ku band and the C band feed assemblies have centerline feeds to their respective probes 20 and 33 and the centerline feeds extend through respective wave guide sections 31 and 40 to couple Ku band and C band energy to their respective wave guide.

The Ku band feed assembly 15 is located behind the C band aperture at a distance approximately ⅓ of the distance from the aperture to the rear wall or bottom of the cup-like portion of the feedhorn which defines a C band cavity. We have found empirically that the Ku band feed assembly 15 has hardly noticeable detremental effects upon signals received by the C band probe 33. Likewise, the C band probe 33, being located to the rear of the Ku band probe 20, does not interfere with Ku band signal detection.

Figure 5:
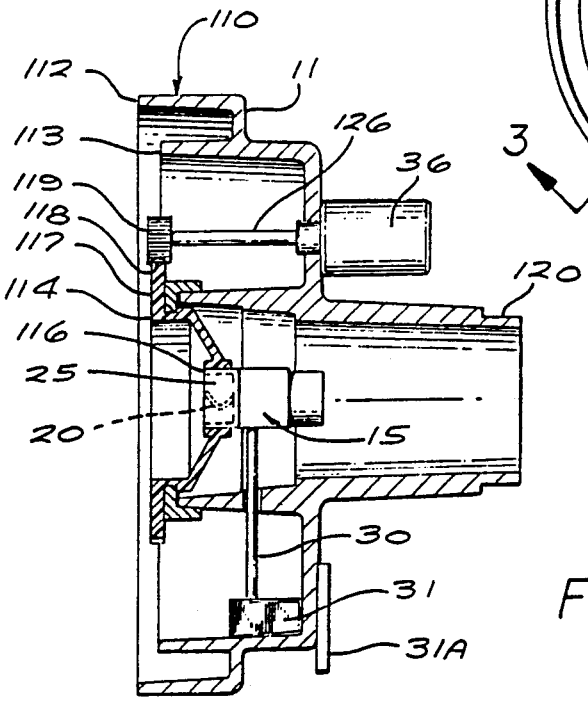
FIG. 5 is a diametrical sectional view of a second embodiment of this invention including an external gear drive system.

We have found that it is possible and practical to have independent drives for the Ku and C band probes with two servo motors both located behind the feedhorn, and particularly without interference by the polarizing drive assembly or the Ku band probe with the C band probe signal detection. Such an arrangement is illustrated in FIG. 5.

Figure 9:
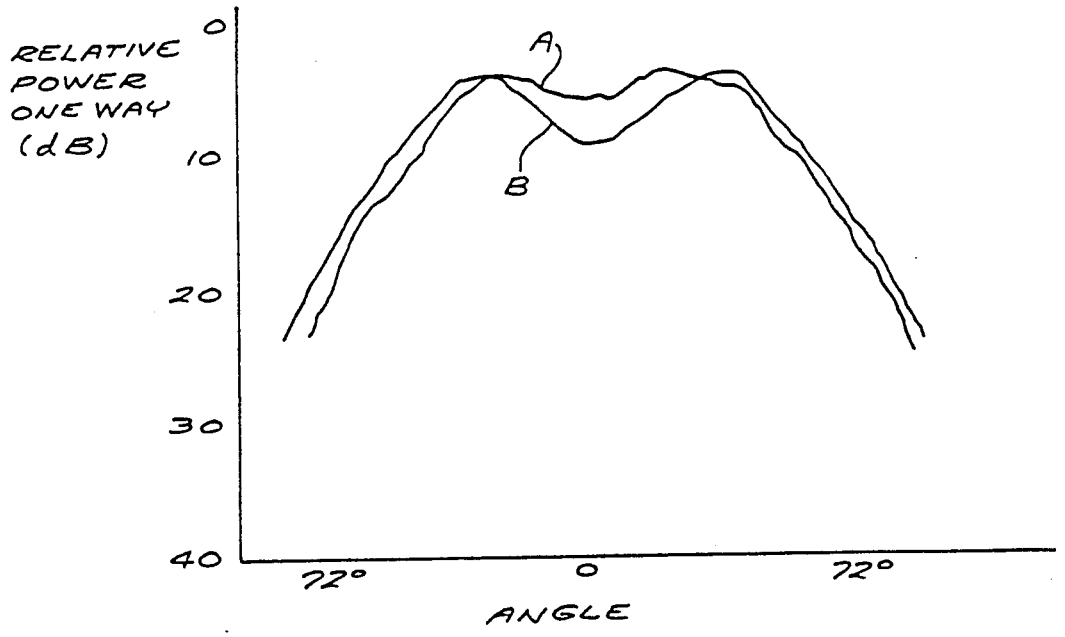
FIG. 9 is a graphical presentation of the same characteristics as FIG. 8 for the assembly of this invention.

Normally, the presence of the second of Ku band probe assembly within the first or C band cavity would degrade the C band operation. We have found, however, that by carefully selecting the dimensions and location of the second probe assembly, not only can degradation of C band operation be avoided but in certain respects, it is enhanced. This improvement is illustrated in FIG. 9 and discussed below.

First, the probe holder for the Ku band probe is dimensioned so that its diameter has a ratio to the diameter of the first or C band cavity in the order of 0.3. In one specific embodiment, the nominal inside dimension of the C band cavity was 2.4 inches and the diameter of the sleeve 16 was 0.8 inch or 0.33 $\lambda_g$(C band). When enlarged to 0.85 inch and 0.90 inch, the C band performance was degraded. The minimum diameter of the Ku band assembly is dictated by the required diameter of the Ku band cavity, namely 0.74 inch or $\lambda_g$(Ku band), the waveguide wavelength. Therefore, 0.8 inch is the minimum practical diameter for the probe holder 16.

The length L of the Ku band assembly 15 is dictated by several considerations. It must allow the coaxial conductor to be aligned at the rear with the probe 20. This requires an L shape or modified U shape for the conductor 30. We have found that an overall length L of the Ku band assembly 15 16 of 1.6 inches provides a structurally and electrically effective design.

Likewise, one would expect that inserting a conductor radially in the C band cavity would virtually short circuit any signal entering the cavity. We have found, however, that the coaxial conductor 30 for the Ku band probe 20 may extend from the Ku band assembly 15 outward through the C band cavity where it is located in the order of 0.6 $\lambda_g$, the waveguide wavelength at the mid band of the lower frequency, e.g. 3.9 ghz for C band.

The presence of the Ku band assembly in the C and cavity and its performance in the C band is best illustrated by reference to FIGS. 8 and 9.

Figure 8:
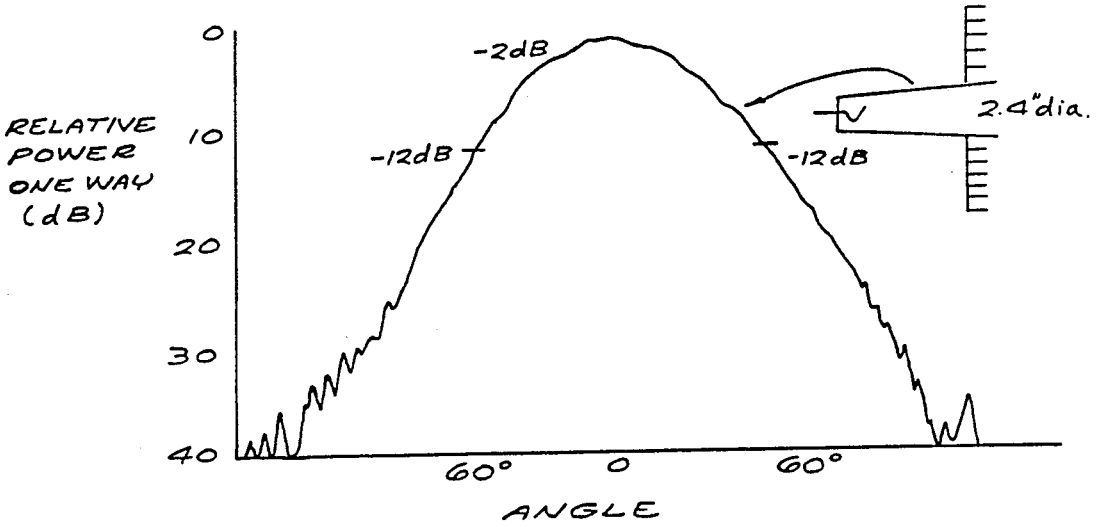
FIG. 8 is a graphical presentation of the relative power/angle characteristic of a standard cavity and probe.

FIG. 8 illustrates a state of the art single probe feed as shown in the small sketch on FIG. 8. It shows a definite bell shaped curve with noticeable side lobes. The peak at −2db is located on the axis and the −12db points at approximately 60 degrees off axis. Optimum performance requires precise directional positioning of the dish.

By way of contrast, curve A of FIG. 9 shows a characteristic of a coaxial assembly as illustrated in FIGS. 1–4 at C band. Instead of the peaked characteristic of FIG. 8, that of FIG. 9 is relatively insensitive to directional errors as much as 40 degrees. The average response between these angles is in the order of −5db. The −10db points are at ±72 degrees in contrast with the typical characteristic of FIG. 8.

When the Ku band assembly 15 is removed and the assembly operated at C band, the characteristic curve B shows a definite valley at 0 degrees orientation. Still the −10 db angles remain unchanged. The relative response over ±36 degrees is in the order of −6db, an acceptable level. With the Ku band probe assembly 15 in place as illustrated in FIGS. 1–4, curve A of FIG. 9 is obtained with enhanced response on axis.

Now referring to FIG. 5, the second embodiment of this invention is illustrated therein in section. In FIG. 5 the same reference numerals are given to identical parts as used in FIGS. 1–4. In this case the feedhorn assembly 110 has an outer ring 112, an inner ring 113 and a lower or C band aperture 114 in which the higher or Ku band assembly 15 is located, similar to the assemblies of FIGS. 1–4. In this case the assembly 15 and probe 20 is coaxially mounted in the aperture 114 by a microwave energy transparent spider 117 on a ring 118. The periphery of a front flange portion of the spider 117 constitutes a ring gear which engages the spur gear 119 on shaft 126 of servo motor 36. The servo motor 36 is located on the rear face of the feed assembly 110 and out of the received energy path. At the rear the servo motor 36 also may easily be protected from the weather by a cover, unshown in the drawing.

Similar to the embodiments of FIGS. 1–4, signals in the Ku band probe 20 are fed by coaxial line 30 from the wave guide termination 31, which, similar to the embodiments of FIGS. 1–4, is available at an integral flange coupling 31A at the rear of the feed assembly ready for engagement with the next section of the wave guide.

In the embodiment of FIG. 5, operation of servo motor 36, driving shaft 126 and spur gear 119 allows rotation of the sleeve 116 which carries the probe 20.

Unshown in FIG. 5 is the C band or lower frequency probe and its own drive and wave guide. The rear of the feedhorn of FIG. 5 is designed to received the identical wavelength structure as illustrated in FIG. 2 on the rear step 120. Alternately, the assembly of FIG. 5 may be operated as a single frequency adjustable polarization feed employing the same casting for the assembly as used in the embodiment of FIGS. 1–4, only adding the spider 117, ring 118 and the elongated shaft 126 and spur gear 119 to the standard servo motor 36. Each of the feeds have independently controlled polarization in the embodiment of FIG. 5.

A third embodiment of this invention appears in fragmentary diametrical sectional view in FIG. 6. The horn assembly 210 is basically of the design shown in FIG. 2 with certain exceptions described below. The high frequency or Ku band assembly 15 is mounted within the aperture 40 but this time from a washer 216 and by the axial support 217 which carries on it the low frequency or C band probe 233. The support 217 extended outside of the rear wall 237 engages the drive 36. The outermost end of the support 217 is secured as by soldering to the Ku band assembly 15. The probe 20 feeds a coaxial line 231 which extends forward through the washer 216 and rearward through the horn body 211.

A fourth embodiment of this invention is illustrated in FIG. 7. This embodiment employs certain of the characteristics of the previous embodiments, in particular, the front drive of the embodiment of FIG. 5, the front feed of the higher frequency probe of FIG. 6 and the dual independent drive capability of the embodiment of FIG. 5.

Referring now to FIG. 7, the basic horn structure 210 is of the type disclosed in FIG. 6 which includes the aperture 40 for the low frequency or C band and a 180 degree slot 301 in the spider 311 through which the fixed coaxial feed 231 extends to the front and then through opening 302 in the feedhorn to the rear where it joins a waveguide transition, unshown in FIG. 7 but similar to the waveguide termination 31 of FIGS. 2 and 3. The high frequency or Ku band assembly 15 is insulatingly mounted with the probe 20 in a rear plug 303 in signal conducting contact with the center conductor of the coaxial lead 231. The plug 303 constitutes the rear of the probe holder equivalent to probe support 26 of FIG. 1 and engages the spider 311 to rotate the probe 20 as the spur gear 119 on shaft 126 is driven by the servo motor 236.

Meanwhile, the lower frequency or C band, probe 33, is driven directly by the drive motor 36. In this embodiment, the two probes 20 and 33 have their polarization independently controllable by their respective motors 236 and 36.

In each of the foregoing embodiments, coaxially mounted higher and lower band probes are disclosed. They are simultaneously controlled in polarization by a single servo motor or may be independently controlled by independent servo motors. The feed for the lower frequency probe is at the rear of the assembly while the feed for the higher frequency or Ku band probe can be either at the front of the assembly or the rear. Regardless of which of these designs is selected, we have found that efficient signal recovery is possible at both frequencies and precise polarization control is possible without unwanted interference at the two bands. The structures are relatively simple and reliable as well.

While experimenting with this invention, we further discovered that with minor structural change in the dual probe assembly, it can be made to convert from either left hand or right hand circular polarization to linear polarization with minimum signal degradation. This is accomplished by augmenting the harp 32 within the C band cavity. As shown in FIG. 10, the harp 32 in its arm portions 32A and 32B which parallel the circular wall of the C band cavity of FIG. 2. The harp 32 is fabricated of dielectric material such as high impact polystyrene. In the embodiment of FIGS. 12 and 13, the arms 32A and B have cross sectional dimensions of ¼ in. by 1/16 in. (6.35 mm by 1.59 mm). In FIGS. 10 and 11, the harp 32 arms 32A and B have dimensions of 0.5 inch by 0.25 inch. (12.5 mm by 6.25 mm) and are oriented at 45 degrees and 135 degrees with respect to the plane of the probe 33. The added dielectric results in a change in the phase of the orthogonal component of the circularly polarized incident energy so that it arrives at the rear of the waveguide, impinging upon the probe 33 coincident with the non delayed signal. The effect is the slowing down of the signal so that the orthogonal component will add in phase with the undelayed signal. This is accomplished with the dielectric on the left side of the probe to convert left hand polarized signals to linear polarization or with the dielectric on the right hand side to convert right handed polarized signals to linear polarization. The placement of the dielectric material on the harp makes it possible to change the handedness of the conversion merely by a 90 degree change of orientation of the harp arms 32A and 32B with respect to the probe 33.

The operation of the phase shifting device may be enhanced by substitution of either ferrite or metal for dielectric in the leg portions 32A and 32B. This aids in the simulation of a rectangular waveguide surrounding the probe 33. The embodiment of FIGS. 12 and 13, the standard harp of FIGS. 2 and 3 is used with a plurality of pins 50 and 51 which project inwardly from the arms 32A and 32B, respectively. The pins are preferably 0.090 in. in diameter, metal and ⅜ in. length. At least 2 pins, directly opposite each other are required located at a ¼ waveguide wavelength from the rear wall of the cavity. At C band, this amounts to approximately 1¼ inch from the rear wall. Extra pins add to the performance of the conversion spaced at ¼ waveguide wavelength. These additional embodiments add to the capabilities of the dual band antenna feed.

This invention shall not be limited to the illustrative embodiments but rather to the claims as set forth below which constitute definitions of this invention including the protection afforded by the doctrine of equivalents.

What is claimed is:

1. A coaxial feed assembly for receiving incident electromagnetic signals and conveying them to an associated signal utilization means outside of said coaxial feed assembly comprising:

a feed assembly body having a boundary wall defining a first elongated waveguide cavity having a first axis, said wall defining a first aperture at a forward end of said cavity and defining a rearward end of said cavity;

a first probe mounted within said first waveguide cavity for receiving electromagnetic energy in a first preselected band of frequencies;

means supporting said first probe in a rearward portion of said first waveguide cavity;

first signal conducting means for conducting electromagnetic energy received by said first probe to the exterior of said body;

whereby electromagnetic energy detected by said first probe may be conducted to a signal utilization means;

means defining a second elongated waveguide cavity of smaller dimension than said first waveguide cavity, said second waveguide cavity having a second axis and having a second aperture at a forward end thereof and being closed at a rearward end thereof;

a second probe mounted within said second waveguide cavity for receiving electromagnetic energy in a second preselected band of frequencies, said second preselected band of frequencies being higher than said first band of frequencies;

means supporting said second probe in said second waveguide cavity;

means mounting said second waveguide cavity coaxially within said first waveguide cavity between said first aperture and said first probe and spaced from the boundary wall of said first waveguide cavity, said first waveguide cavity providing a continous, uninterrupted signal path within said first waveguide cavity, around said second waveguide, for conveying incident electromagnetic signals from said first aperture to said first probe; and second signal conducting means extending into said first waveguide cavity for conducting electromagnetic energy received by said second probe to the exterior of said body.

2. A coaxial feed assembly in accordance with claim 1, wherein said means defining said second waveguide cavity has a length approximately ⅓ of the length of said first waveguide cavity.

3. A coaxial feed assembly in accordance with claim 1, wherein:

said boundary wall defining said first waveguide cavity includes at least one sidewall and an end wall; and said second signal conducting means for conducting electromagnetic energy received by said second probe is located in said first waveguide cavity spaced from the end wall of said first waveguide cavity.

4. A coaxial feed assembly in accordance with claim 1, wherein:

said boundary wall defining said first waveguide cavity includes at least one sidewall and an end wall; and said means defining said second waveguide cavity includes a rear substantially planar face, said rear face being in facing relationship with said end wall of said first waveguide cavity.

5. A coaxial feed assembly in accordance with claim 1, wherein:

said boundary wall defining said waveguide cavity includes a cylindrical wall; and said means defining said second waveguide cavity includes a cylindrical wall having an outside dimension approximately ⅓ of the diameter of said cylindrical wall of said means defining said first waveguide cavity.

6. A coaxial feed assembly in accordance with claim 1, wherein:

said boundary wall defining said first waveguide cavity includes at least one sidewall and an end wall; and said means defining said second waveguide cavity constitutes a cylindrical body having a rear wall spaced from the end wall of said first waveguide cavity equal to approximately ⅓ the length of said first waveguide cavity.

7. A coaxial feed assembly in accordance with claim 1, wherein said means mounting said second waveguide cavity includes a dielectric spider located radially between said boundary wall defining said first waveguide cavity and said means defining said second waveguide cavity.

8. A coaxial feed assembly in accordance with claim 7, wherein said dielectric spider includes an inner circular ring engaging said means defining said second waveguide cavity.

9. A coaxial feed assembly in accordance with claim 7, wherein said dielectric spider includes a substantially planar washer.

10. A coaxial feed assembly in accordance with claim 7, wherein said second signal conducting means cooperates with said means mounting said second waveguide cavity to position said second waveguide cavity within said first waveguide cavity.

11. A coaxial dual frequency antenna feed assembly comprising:

a horn having a boundary wall defining a first elongated waveguide cavity having a first axis, said boundary wall defining a first aperture at a forward end of said cavity and defining a rearward end of said cavity;

a first probe for detecting electromagnetic energy in a first frequency band exposed to incident electromagnetic energy in said first aperture and positioned in a rearward portion of said first waveguide cavity, including a portion thereof coaxial with said first waveguide cavity;

means outside of said first waveguide cavity for rotating said first probe to change the polarization thereof;

means defining a second elongated waveguide cavity of smaller size than said first waveguide cavity, said second waveguide cavity having a second axis and having a second aperture at a forward end thereof and being closed at a rearward end thereof;

a second probe exposed to incident electromagnetic energy in said second aperture and positioned within said second waveguide cavity for detecting electromagnetic energy entering said second aperture in a higher frequency band than electromagnetic energy detected by said first probe;

means for positioning said means defining said second waveguide cavity coaxially within said first waveguide cavity, between said first aperture and said first probe, such that said means defining said second waveguide cavity is spaced from the boundary wall defining said first waveguide cavity, said first waveguide cavity providing a continuous, uninterrupted signal path within said first waveguide cavity, around said second waveguide cavity, for conveying incident electromagnetic signals from said first aperture to said first probe;

signal conducting means for transmaitting electromagnetic energy detected by said second probe to the exterior of said first waveguide cavity; and means for rotating said second probe to change the polarization thereof, said means for rotating said second probe extending through a portion of said first waveguide cavity.

12. A coaxial dual frequency antenna feed assembly in accordance with claim 11, wherein said means defining said second aperture and waveguide cavity has a length approximately ⅓ the length of said first aperture and waveguide cavity.

13. A coaxial dual frequency feed assembly in accordance with claim 11, wherein:

said boundary wall defining said first waveguide cavity include a cylindrical wall and an end wall; and said signal conducting means for conducting electromagnetic energy received by said second probe is located in said first waveguide cavity, spaced from said end wall of said first waveguide cavity.

14. A coaxial dual frequency antenna feed assembly in accordance with claim 11, wherein:

said boundary wall defining said first waveguide cavity include a cylindrical wall and an end wall; and said means defining said second waveguide cavity includes a rear substantially planar face in facing relationship with said end wall of said first waveguide cavity.

15. A coaxial dual frequency antenna feed assembly in accordance with claim 11, wherein:

said first waveguide cavity has a substantially circular cross-section; and said means defining said second waveguide cavity includes a cylindrical wall having an outside dimension approximately ⅓ the diameter of said first waveguide cavity.

16. A coaxial dual frequency antenna feed assembly in accordance with claim 11, wherein:

the boundary wall defining said first aperture and waveguide cavity include a cylindrical wall and an end wall; and said means defining said second waveguide cavity includes a cylindrical body having a rear wall spaced from the end wall of said first waveguide cavity approximately ⅓ the length of said first waveguide cavity.

17. A coaxial dual frequency antenna feed assembly in accordance with claim 11, wherein said means for positioning includes a dielectric spider located radially between the boundary wall defining said first waveguide cavity and said means defining said second waveguide cavity.

18. A coaxial dual frequency antenna feed assembly in accordance with claim 17 wherein said dielectric spider includes an inner circular ring engaging said means defining said second waveguide cavity.

19. A coaxial dual frequency antenna feed assembly in accordance with claim 17, wherein said dielectric spider includes a substantially planar washer.

20. A coaxial dual frequency antenna feed assembly in accordance with claim 17, wherein said signal conducting means cooperates with said means for positioning said second waveguide cavity to position said second waveguide cavity within said first waveguide cavity.

* * * * *

UNITED STATES PATENT AND TRADEMARK OFFICE

CERTIFICATE OF CORRECTION

PATENT NO. : 5,107,274

DATED : April 21, 1992

INVENTOR(S) : Rodney A. Mitchell et al.

It is certified that error appears in the above-identified patent and that said Letters Patent is hereby corrected as shown below:

On title page, item [56]

Under References Cited after "U.S. Patent Documents" change "4,554,532" to --4,554,552--.

In Column 3, line 65, "probe" should be --feed--.

In Column 4, line 20, after "distance" insert --D--.

In Column 5, line 60, change "wavelength" to --waveguide--.

Signed and Sealed this

Fifth Day of October, 1993

Bruce Lehman

*Attest:*

BRUCE LEHMAN

*Attesting Officer*

*Commissioner of Patents and Trademarks*

US005107274A

REEXAMINATION CERTIFICATE (2469th)

United States Patent [19]

[11] B1 5,107,274

Mitchell et al.

[45] Certificate Issued Feb. 7, 1995

[54] COLLOCATED NON-INTERFERING DUAL FREQUENCY MICROWAVE FEED ASSEMBLY

[75] Inventors: Rodney A. Mitchell, Tujunga; Gerry B. Blachley, Simi Valley, both of Calif.

[73] Assignee: Antenna Down Link, Inc., Las Vegas, Nev.

Reexamination Request:
No. 90/003,422, May 5, 1994

Reexamination Certificate for:

| | |
|---|---|
| Patent No.: | **5,107,274** |
| Issued: | **Apr. 21, 1992** |
| Appl. No.: | **405,548** |
| Filed: | **Sep. 11, 1989** |

Certificate of Correction issued Oct. 5, 1993.

Related U.S. Application Data

[63] Continuation of Ser. No. 105,135, Oct. 2, 1987, Pat. No. 4,903,037.

[51] Int. Cl.[6] ..... H01Q 13/02

[52] U.S. Cl. ..... 343/756; 343/786; 333/21 A; 333/135

[58] Field of Search ..... 343/756, 762, 766, 776, 343/786; 333/21 A, 135

[56] References Cited

U.S. PATENT DOCUMENTS

| | | | |
|---|---|---|---|
| 2,425,488 | 8/1947 | Peterson et al. | 343/786 |
| 3,731,236 | 5/1973 | Di Tullio et al. | 343/756 |
| 3,864,687 | 2/1975 | Walters et al. | 343/778 |
| 4,282,527 | 8/1981 | Winderman et al. | 343/725 |
| 4,529,989 | 7/1985 | Dupressoir et al. | 343/756 |
| 4,740,795 | 4/1988 | Seavey | 343/786 |
| 4,785,306 | 11/1988 | Adams | 343/786 |
| 5,003,321 | 3/1991 | Smith et al. | 343/781 R |

FOREIGN PATENT DOCUMENTS 893476 7/1944 France .

OTHER PUBLICATIONS

Samuel Silver, "Microwave Antenna Theory and Design", Peter Peregrinus Ltd., 1984, pp. 221-223.

*Primary Examiner*—Michael C. Wimer

[57] ABSTRACT

A dual frequency feed assembly for an antenna system having two coaxial cavities, with a smaller, high-frequency cavity mounted coaxially within a larger, low-frequency cavity. A separately rotatable probe is mounted within each cavity. The smaller cavity is mounted within the larger cavity by any of several structures, such as a ring-shaped spider, a ring-shaped spacer in the form of a planar washer, or a harp extending rearwardly in the larger cavity.

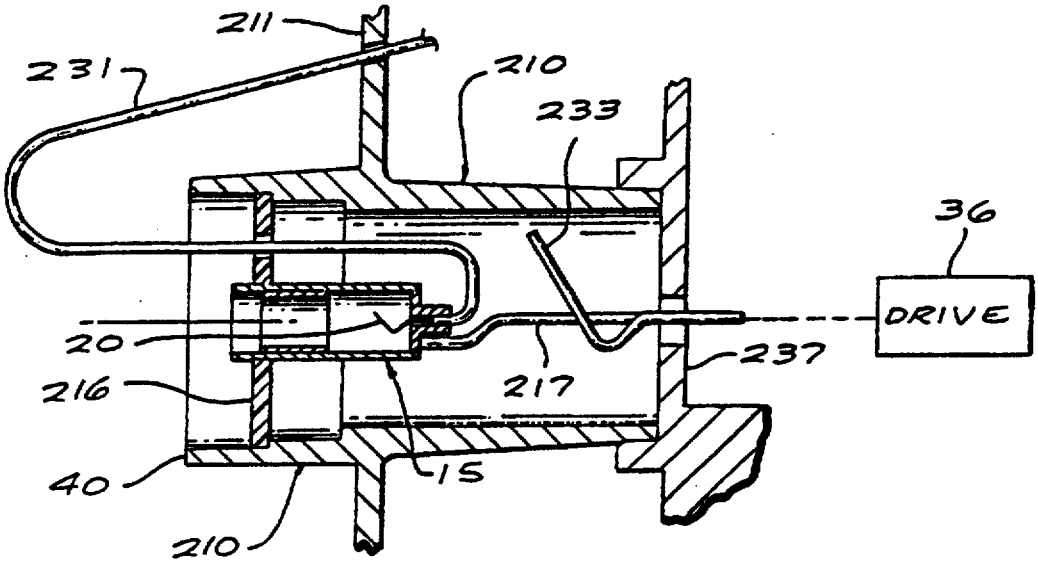

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–20 is confirmed.

* * * * *